US010994540B2

(12) United States Patent
Terasaki

(10) Patent No.: US 10,994,540 B2
(45) Date of Patent: May 4, 2021

(54) METHOD OF MANUFACTURING SUBSTRATE, METHOD OF MANUFACTURING SUBSTRATE STACK AND METHOD OF MANUFACTURING LIQUID EJECTION HEAD

(71) Applicant: CANON KABUSHIKI KAISHA, Tokyo (JP)

(72) Inventor: Atsunori Terasaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 16/668,340

(22) Filed: Oct. 30, 2019

(65) Prior Publication Data

US 2020/0147958 A1 May 14, 2020

(30) Foreign Application Priority Data

Nov. 8, 2018 (JP) ..... JP2018-210573

(51) Int. Cl.
*B41J 29/38* (2006.01)
*B41J 2/14* (2006.01)

(52) U.S. Cl.
CPC ..... *B41J 2/1404* (2013.01); *B41J 2/14145* (2013.01)

(58) Field of Classification Search
CPC ..... B41J 2/1626; B41J 2/1634; B41J 2/1603
See application file for complete search history.

(56) References Cited

U.S. PATENT DOCUMENTS 6,555,480 B2 * 4/2003 Milligan ..... B41J 2/1404 216/2
6,563,079 B1 * 5/2003 Umetsu ..... H01L 21/486 219/121.71
6,776,916 B2 * 8/2004 Hess ..... B41J 2/14145 216/2
8,052,828 B2 11/2011 Takahashi et al.
8,240,828 B2 8/2012 Sharan et al.
2007/0019043 A1 * 1/2007 Oya ..... B41J 2/1645 347/70
2007/0212890 A1 * 9/2007 Sakai ..... B41J 2/1628 438/733

FOREIGN PATENT DOCUMENTS

JP 2006-227544 A 8/2006

* cited by examiner

*Primary Examiner* — Lam S Nguyen
(74) *Attorney, Agent, or Firm* — Venable LLP

(57) ABSTRACT

A substrate having an obliquely running through hole is manufactured by arranging first and second masks each having an opening pattern on first and second surfaces, respectively, of the substrate, then forming cavities each facing an opening of the opening patterns from the respective surfaces by anisotropic dry etching, and making the cavities formed from the first surface and the cavities formed from the second surface communicate with each other to produce the through hole. The opening pattern of the first mask and the opening pattern of the second mask are arranged adjacently to or partially overlapping with each other as viewed from the direction orthogonal to the substrate. The opening area of at least one of the openings of the first and second masks are increased along the direction from the mask including the at least one opening toward the oppositely disposed mask.

10 Claims, 13 Drawing Sheets

FIG. 4A1
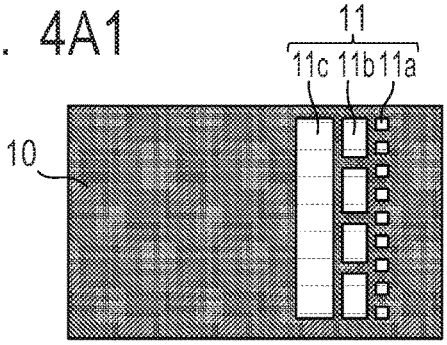
FIG. 4B1
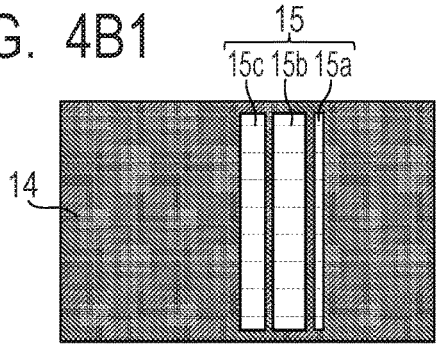
FIG. 4A2
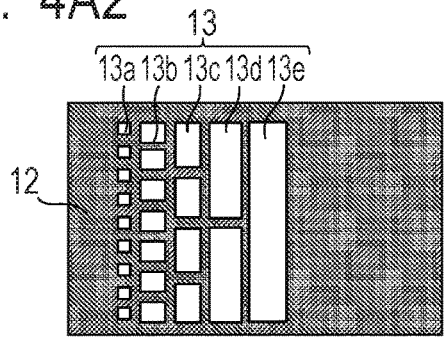
FIG. 4B2
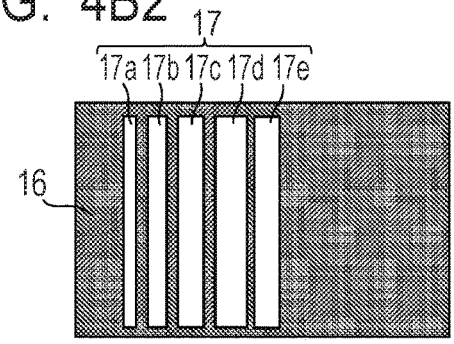
FIG. 4A3
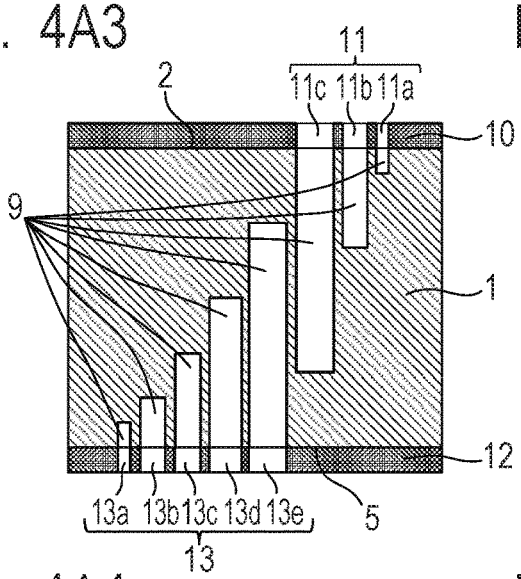
FIG. 4B3
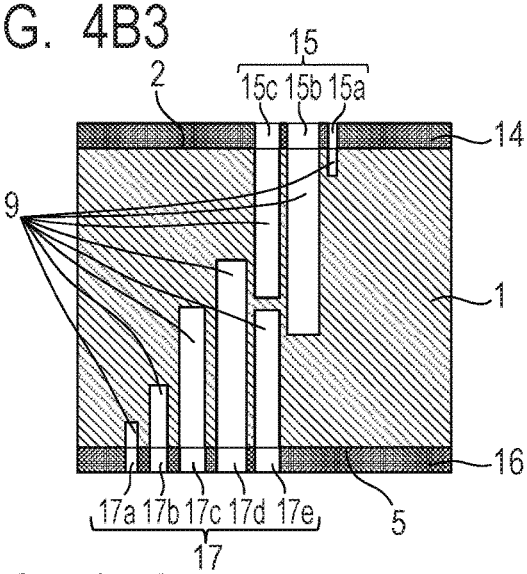
FIG. 4A4
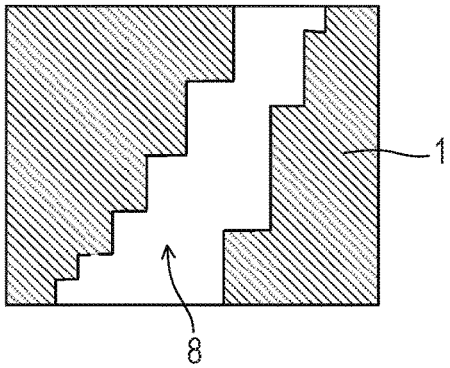
FIG. 4B4
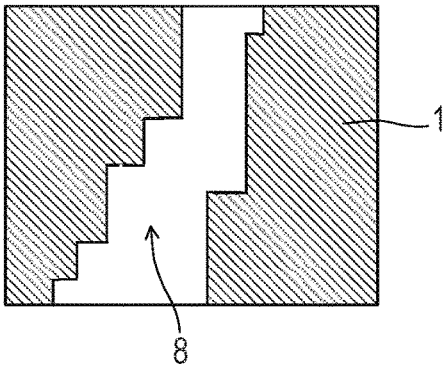

METHOD OF MANUFACTURING SUBSTRATE, METHOD OF MANUFACTURING SUBSTRATE STACK AND METHOD OF MANUFACTURING LIQUID EJECTION HEAD

BACKGROUND OF THE INVENTION

Field of the Invention

The present invention relates to a method of manufacturing a substrate, a method of manufacturing a substrate stack and a method of manufacturing a liquid ejection head.

Description of the Related Art

In any popularly available liquid ejection heads, the liquid stored in a tank is supplied to common liquid chambers, then driven out from the common liquid chambers to get to ejection orifices by way of pressure chambers and finally ejected to the outside from the ejection orifices. The flow paths that connect the tank, the common liquid chambers, the pressure chambers and the ejection orifices are generally formed by digging into a structure including a substrate, a flow path forming member and an ejection orifice forming member and, in certain instances, they are formed as through holes running through the structure. Japanese Patent Application Laid-Open No. 2006-227544 describes a method of manufacturing an organic resin-made structure on a substrate having micro-cavities by pasting a photosensitive resin film onto the substrate and executing an exposure and development process on the photosensitive resin film. Then, ejection orifices and other components are formed in the structure manufactured by the above-described method.

Both the cross sections and the degree of accumulation of paths of a liquid ejection head, through which liquid flows, change from the tank down to the ejection orifices. In particular, the trend toward micronization and a higher degree of accumulation of ejection orifices has been promoted and consequently the pitch of arrangement of common liquid chambers has been micronized. Then, accordingly, the pitch of arrangement of the flow paths (pipes) connecting the tank and the common liquid chambers needs to be shifted, or converted, so as to raise the pitch in the area where the flow paths are connected to the tank but reduce the pitch in the area where they are connected to the common liquid chambers. There are instances where piping involving such a pitch conversion is realized by using a molded object of sintered alumina or resin. The dimensional limit to such a piping process is about 1 mm and hence it is difficult to produce a structure where a finer pitch conversion can be realized. In view of this problem, U.S. Pat. No. 8,240,828 proposes a method of using a silicon substrate having obliquely running through holes as a pitch converting member.

With the method of U.S. Pat. No. 8,240,828, a member having obliquely running through holes (interposer) is prepared as pitch converting member to be connected between flow paths that are arranged at a pitch of hundreds of several micrometers and flow paths that are arranged at a pitch of several millimeters. With an exemplar method of preparing such an interposer, a pair of masks 53, 56 are arranged respectively on the oppositely disposed surfaces (surface 52, surface 55) of a substrate 51 as shown in FIG. 13A. The masks 53, 56 have respective openings 54, 57 that are adjacently located when viewed in the direction that orthogonally intersects the substrate 51. Then, cavities 59, 60 that operate as lead holes are formed typically by executing an operation of laser irradiation or dry etching on the oppositely disposed surfaces (surface 52, surface 55) of the substrate 51 by way of the respective masks 53, 56 (FIG. 13B). Subsequently, the cavities 59, 60 are expanded by means of isotropic etching such as wet etching until they communicate with each other to produce an obliquely running through hole 58.

However, with the above-described method, it is difficult to make the etching operation, which comes after the formation of the cavities 59, 60, proceed only in the intended direction so as to produce a through hole 58 showing a desired profile as indicated by two-dot chain lines in FIG. 13C. In actuality, both of the cavities 59, 60 are isotropically etched to increase their diameters and produce a warped through hole whose diameter is, at least partly, unnecessarily aggrandized as indicated by solid lines in FIG. 13C. When the diameter of such a through hole 58 is an unnecessarily aggrandized one, the interval between any two adjacently located through holes 58, 58 to be formed in the substrate 51 needs to be made to show a relatively large value in order to avoid any interference between them. Then, as a result, the pitch of arrangement of through holes cannot satisfactorily be reduced. Additionally, when the openings 54, 57 of the masks 53, 56 on the oppositely disposed surfaces (surface 52, surface 55) of the substrate 51 are separated too much from each other in the horizontal direction (in the direction running along the surfaces of the substrate 51), the etching operation of connecting the pair of cavities 59, 60 formed from the oppositely disposed surfaces (surface 52, surface 55) of the substrate 51 requires a long time before the cavities 59, 60 are actually connected to each other to produce a through hole 58. Then, the net result will be a further aggrandizement of the diameters of adjacently located through holes 58, 58 to make it necessary to further increase the pitch of arrangement of through holes 58, 58 for the purpose of avoiding any interference between the two adjacently located through holes 58. As described above, with the method of U.S. Pat. No. 8,240,828, any effort for reducing the pitch of arrangement of flow paths faces a limit and hence it is difficult to manufacture a pitch converting member showing a high pitch conversion rate. Additionally, a through hole 58 having a warped profile as indicated by solid lines in FIG. 13C may not allow a smooth liquid flow to take place.

SUMMARY OF THE INVENTION

A method of manufacturing a substrate having a through hole running obliquely relative to the substrate according to the present invention comprises: a step of arranging a first mask having an opening pattern including a plurality of openings on a first surface of the substrate and arranging a second mask having an opening pattern including a plurality of openings on a second surface of the substrate disposed oppositely relative to the first surface; a step of forming a plurality of cavities respectively facing the plurality of openings of the first mask by executing an anisotropic dry etching operation from the first surface by way of the first mask and forming a plurality of cavities respectively facing the plurality of openings of the second mask by executing an anisotropic dry etching operation from the second surface by way of the second mask; and a step of forming the through hole by making the cavities formed by dry etching from the first surface communicate with the cavities formed by dry etching from the second surface by removing separating walls, located among the cavities; the opening pattern of the first mask and the opening pattern of the second mask being arranged adjacently relative to each other or partly overlapped with each other as viewed in the direction orthogonal relative to the first surface and the second surface of the substrate; the opening area of at least one of the plurality of openings of the first mask and of the second mask being increased along the direction from the opening pattern of the mask including the at least one opening toward the opening pattern of the oppositely disposed mask as viewed in the direction orthogonal relative to the first surface and the second surface of the substrate.

Further features of the present invention will become apparent from the following description of exemplary embodiments with reference to the attached drawings.

BRIEF DESCRIPTION OF THE DRAWINGS

FIGS. 4A1, 4A2, 4A3 and 4A4 are schematic plan views and schematic cross-sectional views of another pair of masks that can be used for an embodiment obtained by modifying the embodiment of FIGS. 1A through 1D, and FIGS. 4B1, 4B2, 4B3 and 4B4 are schematic plan views and schematic cross-sectional views of still another pair of masks that can be used for the embodiment obtained by modifying the embodiment of FIGS. 1A through 1D.

DESCRIPTION OF THE EMBODIMENTS

The object of the present invention is to provide a method of manufacturing a substrate having obliquely running through holes whose pitch of arrangement can efficiently be converted, a method of manufacturing a substrate stack formed by using such substrates and a method of manufacturing a liquid ejection head.

Figure 1A:
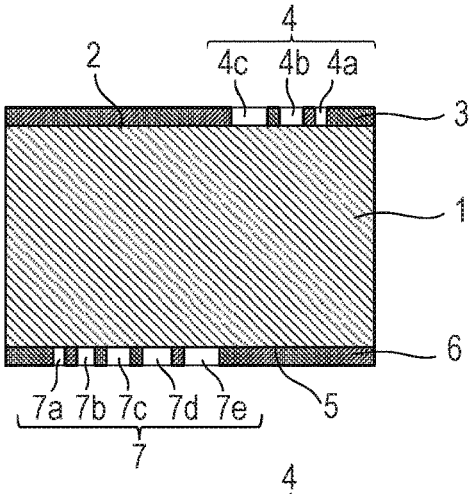
FIGS. 1A, 1B, 1C and 1D are schematic cross-sectional views of a substrate, illustrating steps of a method of manufacturing a substrate, which method is the first embodiment of the present invention.

Now, the present invention will be described below by way of currently preferred embodiments. FIGS. 1A through 1D schematically illustrate a method of manufacturing a substrate according to the present invention. Such a substrate 1 can be one of the substrates that a liquid ejection head to be manufactured by a method according to the present invention comprises. The substrate has through holes that obliquely run through the substrate as viewed in the thickness direction and also in a direction running along the flat surfaces of the substrate. With this manufacturing method, a first mask 3 having an opening pattern 4 that includes a plurality of openings (a group of openings) is formed on a first surface 2 of substrate 1 as shown in FIG. 1A, which substrate is a silicon substrate. Then, a second mask 6 also having an opening pattern 7 that includes a plurality of openings (a group of openings) is formed on a second surface 5 of substrate 1. In the instance shown in FIG. 1A, the opening pattern 4 of the first mask 3 includes three openings 4*a* through 4*c* and the opening pattern 7 of the second mask 6 includes five openings 7*a* through 7*e*. FIGS. 2A and 2B respectively show a plan view of the first mask 3 and a plan view of the second mask 6. When viewed in the direction orthogonal relative to the flat surfaces (the first surface 2 and the second surface 5) (the direction orthogonally intersecting the substrate), the opening pattern 4 of the first mask 3 and the opening pattern 7 of the second mask 6 are arranged adjacently relative to each other. When viewed in the direction orthogonal relative to the flat surfaces of the substrate, the openings of the first mask 3 are arranged in the ascending order of opening areas from the rightmost opening 4*a* to the leftmost opening 4*c*. In other words, the areas of the openings gradually rise from the opening located remotest from the opening pattern 7 of the second mask 6 toward the opening located closest to the opening pattern 7 of the second mask 6 as seen from FIGS. 1A and 2A. On the other hand, the openings of the second mask 6 are arranged in the ascending order of opening areas from the leftmost opening 7*a* to the rightmost opening 7*e*, in other words, the areas of the openings gradually rise from the opening located remotest from the opening pattern 4 of the first mask 3 toward the opening located closest to the opening pattern 4 of the first mask 3 as seen from FIGS. 1A and 2B.

The silicon substrate 1 is then processed by means of anisotropic dry etching. More specifically, the substrate 1 is etched both from the side of the first surface 2 and from the side of the second surface 5. The etching process may be started either from the side of the first surface 2 or from the side of the second surface 5. As a result of the etching process, a cavity 9 is formed from each of the openings 4*a* through 4*c* and 7*a* through 7*e* of the first and second masks 3 and 6. The depths of the cavities 9 correspond to the areas of the respective openings 4*a* through 4*c* and 7*a* through 7*e*. The differences of the depths of the cavities 9 are attributable to a microloading effect. A microloading effect is a phenomenon that the etching rate rises as the opening area of opening increases. Such a phenomenon arises because the ion components and the radical components that participate in the etching process face a difficulty of penetrating deeper into the inside of the substrate from the opening as the opening area of the opening gets smaller. The difference of depth of etching is generally thought to be dependent on the logarithm of the opening area and expressed by the formula shown below.

$$d=A \log S+B \quad \text{(formula 1)}$$

where d is the depth of etching and S is the opening area, whereas A and B represent so many constants.

The openings 4*a* through 4*c* and 7*a* through 7*e* of the first and second masks shown in FIGS. 2A and 2B are formed so as to respectively show predetermined opening areas. When calculations are made by using the logarithmic values of the opening areas and the above formula 1, it will be proven that the depths that correspond to the respective opening areas 4*a* through 4*c* and 7*a* through 7*e* are expressed by a linear function.

Subsequently, the parts of the substrate that are separating the cavities produced by the etching process (separating walls) are removed. While an isotropic etching technique such as dry etching or wet etching can suitably be used to remove the separating walls, the separating walls may alternatively be removed by physical means such as gas or liquid blowing or ultrasonic cleaning. As a result of removing the separating walls, an obliquely running through hole 8 is produced as shown in FIG. 1C. Finally, the operation of forming a substrate 1 having an obliquely running through hole 8 by means of the present invention is completed by removing the first mask 3 and the second mask 6 (FIG. 1D). Strictly speaking, the through hole 8 has a staircase-like lateral wall and extends, slightly shifting its position stepwise in a direction running in parallel with the surfaces of the substrate 1 (horizontal direction) from its opening end 8*a* that faces the opening pattern 4 of the first mask 3 to its opening end 8*b* that faces the opening pattern 7 of the second mask 6. In this specification, such a through hole 8 is regarded as an obliquely running through hole 8 without paying attention to the profiles of minute parts of the through hole 8. Then, the angle formed by the straight line that connects the center of the opening pattern 4 of the first mask 3 and the center of the opening pattern 7 of the second mask 6 and the normal to the substrate that extends orthogonally relative to the surfaces of the substrate 1 is defined as the angle of inclination of the through hole 8.

Of the obliquely running through hole 8, the opening end 8*a* on the first surface 2 extends from the opening 4*a* located at one of oppositely disposed ends of the opening pattern 4 to the opening 4*c* located at the other end of the opening pattern 4 of the first mask 3 on the first surface 2 of the substrate 1, while the opening end 8*b* on the second surface 5 extends from the opening 7*e* located at one of oppositely disposed ends of the opening pattern 7 to the opening 7*a* located at the other end of the opening pattern 7 of the second mask 6 on the second surface 5 of the substrate 1. Since the opening pattern 4 of the first mask 3 and the opening pattern 7 of the second mask 6 are arranged adjacently relative to each other when viewed in the direction that is orthogonal relative to the flat surfaces of the substrate, the through hole 8 obliquely runs between the opening end 8*a* on the first surface 2 and the opening end 8*b* on the second surface 5. Therefore, the degree of inclination of the through hole 8 can be defined by the positional arrangement of the opening pattern 4 of the first mask 3 and the positional arrangement of the opening pattern 7 of the second mask 6. For example, when the opening pattern 7 of the second mask 6 occupies an area greater than the area that the opening pattern 4 of the first mask 3 occupies as viewed in the direction that is orthogonal relative to the flat surfaces of the substrate, the lateral wall of the through hole 8 on the side of the opening pattern 4 of the first mask 3 and hence on the right side in FIG. 1D is inclined relatively steeply and, on the other hand, the lateral wall on the side of the opening pattern 7 of the second mask 6 and hence on the left side in FIG. 1D is inclined relatively gently. Additionally, the cross-sectional area of the through hole 8 is gradually diminished from the opening end 8*b* of the second surface 5 toward the opening end 8*a* of the first surface 2. The angle of inclination of the through hole 8 can be modified by changing the gap separating the opening pattern 4 of the first mask 3 and the opening pattern 7 of the second mask 6 that are located adjacently when viewed in the direction orthogonal relative to the flat surfaces of the substrate 1. Thus, a through hole 8 having a desired angle of inclination can be formed by selectively using the above-described techniques. Furthermore, a plurality of through holes having respective angles of inclination that may differ from each other can be formed in the same substrate at a time by forming a plurality of opening patterns in each of the first mask 3 and the second mask 6. The technique of forming a plurality of through holes will be described in greater detail hereinafter.

Figure 1B:
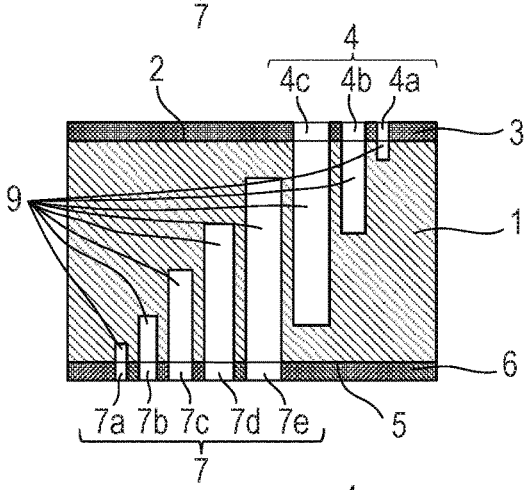
Figure 1C:
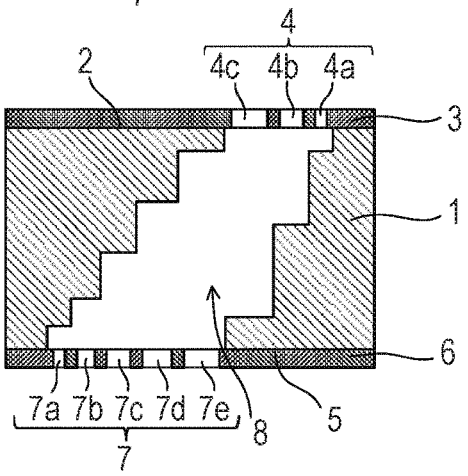
Figure 1D:
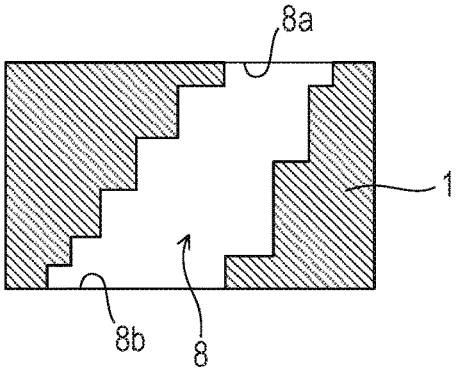
Figure 2A:
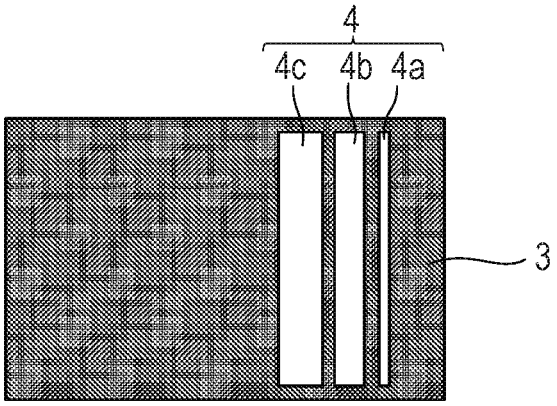
FIGS. 2A and 2B are schematic plan views of a pair of masks that can be used for the manufacturing method illustrated in FIGS. 1A through 1D.
Figure 2B:
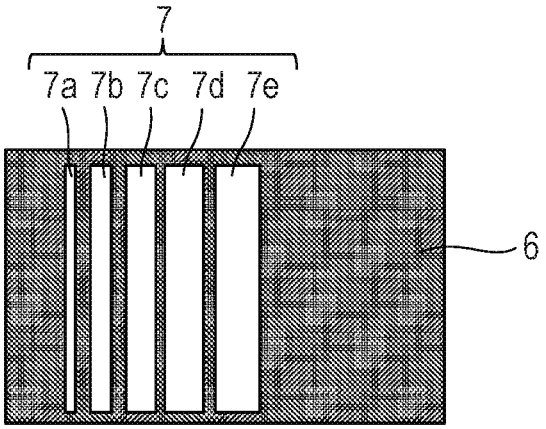

In the instance shown in FIG. 1B, both the etching operation from the side of the first surface 2 and the etching operation from the side of the second surface 5 are suspended at a stage where even the cavities 9 starting respectively from the opening 4*c* having the largest opening area on the side of the first surface 2 and from the opening 7*e* having the largest opening area on the side of the second surface 5 do not get to the other side and hence do not run through the substrate 1. However, it does not matter if the etching operations are made to proceed until the cavities 9 starting from some of the openings get to the other side and hence run through the substrate 1. If such is the case, as seen from FIG. 3, the opening widths of the opening ends 8*a*, 8*b* of the through hole 8 become greater than their counterparts shown in FIG. 1D.

Figure 3:
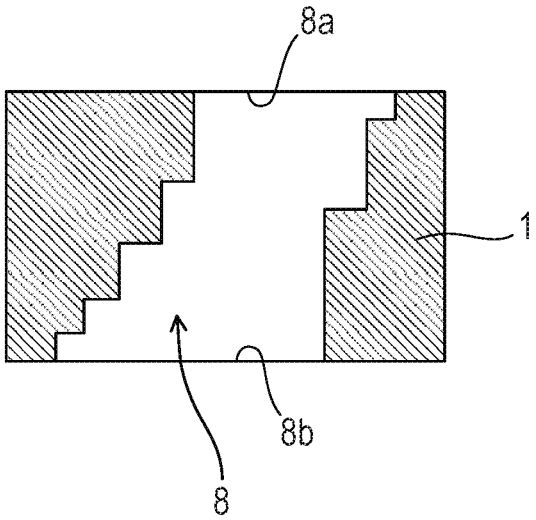
FIG. 3 is a schematic cross-sectional view of another substrate manufactured by the manufacturing method illustrated in FIGS. 1A through 1D.

FIGS. 4A1 and 4A2 are schematic plan views of a first mask 10 and a second mask 12 that can be used for a modified embodiment of this embodiment. FIG. 4A3 is a schematic cross-sectional view of a substrate 1 in which cavities 9 are formed by using the masks 10 and 12. FIG. 4A4 is a schematic cross-sectional view of the substrate 1 in which a through hole 8 is formed from the cavities 9 shown in FIG. 4A3. The technical meaning of this modified embodiment will be described below. When forming a mask having openings whose opening widths are relatively small, there can be instances where the sizes of the openings are subject to limitations that are attributable to the capacity of the exposure equipment to be used for forming the mask. Then, for example, it may be difficult to form an opening having a small opening width and a large opening length. In such an instance, it may be recommendable to arrange a plurality of openings all of which have a small opening width and a small opening length. With the modified embodiment illustrated in FIGS. 4A1 and 4A2, an opening pattern 11 that includes a row of a plurality of openings 11*a*, each having a small opening area, a row of a plurality of openings 11*b*, each having a medium opening area, and a single opening 11*c* having a large area are formed in the first mask 10. On the other hand, an opening pattern 13 that includes a first row of a plurality of openings 13*a*, a second row of a plurality of openings 13*b*, a third row of a plurality of openings 13*c*, a fourth row of a plurality of openings 13*d*, the openings of each of the rows having the same size, the first through fourth rows being arranged in the ascending order of the sizes of the openings from the first row, and a single large-sized opening 13*e* is formed in the second mask 12. As shown in formula 1, the determinant of the etching depth of a cavity formed from an opening is not the opening width of the opening but the opening area of the opening. Therefore, it is possible to produce cavities 9 having different etching depths by forming openings having the same opening width but having respective opening areas that differ from each other as shown in FIG. 4A3. Then, a through hole 8 as shown in FIG. 4A4 can be produced by removing the separating walls among the cavities 9. Note that FIGS. 4A3 and 4A4 show the different etching depths of the cavities 9 that correspond to the respective openings 11*a* through 11*c* and 13*a* through 13*e* of the opening patterns 11, 13 shown in FIGS. 4A1 and 4A2.

In the instance shown in FIGS. 4A1 through 4A4, when viewed in the direction orthogonal relative to the flat surfaces of the substrate 1, the opening patterns 11A through 11C of the first mask 10 and the opening patterns 13A through 13E of the second mask 12 are located adjacent relative to each other. Note, however, that opening 15*c* and opening 17*e* that overlap each other when viewed in the direction orthogonal relative to the flat surfaces of a substrate 1 may be provided respectively in a first mask 14 and in a second mask 16 as shown in FIGS. 4B1 and 4B2, which illustrate another modified embodiment of the present invention. With such an arrangement, the front end of the cavity 9 starting from the opening 15*c* of the first mask 14 on the first surface 2 is located close to the front end of the cavity 9 starting from the opening 17*e* of the second mask 16 on the second surface 5, the opening 15*c* and the opening 17*e* overlapping each other when viewed in the direction orthogonal relative to the flat surfaces of the substrate 1 as shown in FIG. 4B3. Then, as shown in FIG. 4B4, all the cavities 9 are made to communicate with each other by removing the separating walls and the part of the substrate 1 located between the front ends of the cavities 9 starting from the oppositely disposed openings 15*c* and 17*e*. Alternatively, the etching operation of forming a cavity starting from the opening 15*c* on the first surface 2 and the etching operation of forming a cavity from the opening 17*e* on the second surface 5, the opening 15*c* and the opening 17*e* being disposed oppositely relative to each other, may be made to proceed until the front ends of the cavities get to each other so as to make the cavities 9 communicate with each other and produce a through hole there. In either case, the front ends of the cavities 9 starting from the oppositely disposed openings 15*c* and 17*e* of the respective first surface 2 and second surface 5 are ultimately made to communicate with each other and produce a through hole there. Therefore, the cavity 9 formed from the first surface 2 and the cavity 9 formed from the second surface 5 are not required to have individual large depths and, hence, each of the openings 15*c*, 17*e* that overlap each other when viewed in the direction orthogonal relative to the flat surfaces of the substrate 1 may not have a large area. On the other hand, the opening areas of the openings 15*a* and 15*b* of the opening pattern 15 and those of the openings 17*a* through 17*d* of the opening pattern 17 that are located adjacently but do not overlap when viewed in the direction orthogonal relative to the flat surfaces of the substrate 1 are preferably so arranged that the opening areas of the openings 15*a* and 15*b* of the opening pattern 15 or the opening areas of the openings 17*a* through 17*d* of the opening pattern 17 increase as they come closer to the other opening pattern 17 or 15. Note, however, that the opening areas of all the openings are not required to be based on the above-described principle. In short, at least part of the plurality of openings are preferably arranged in the above-described manner when viewed in the direction orthogonal relative to the flat surfaces of the substrate 1. Differently stated, the opening area of an opening of one of the opening patterns that is located closer to the other opening pattern is greater than the opening area of another opening of that opening pattern located remoter from the other opening pattern. Then, as a result, the advantageous effect of the present invention that an obliquely running through hole 8 can be formed with ease will be obtained.

Figure 5A:
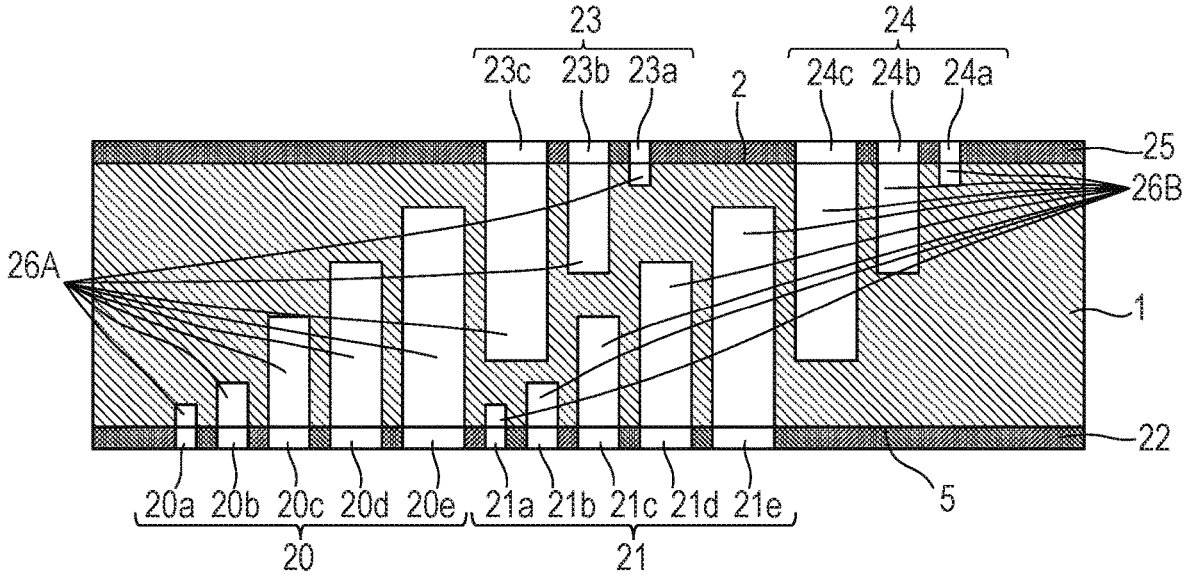
FIGS. 5A and 5B are schematic cross-sectional views of a substrate, illustrating a process of forming a plurality of through holes by the manufacturing method of FIGS. 1A through 1D.
Figure 5B:
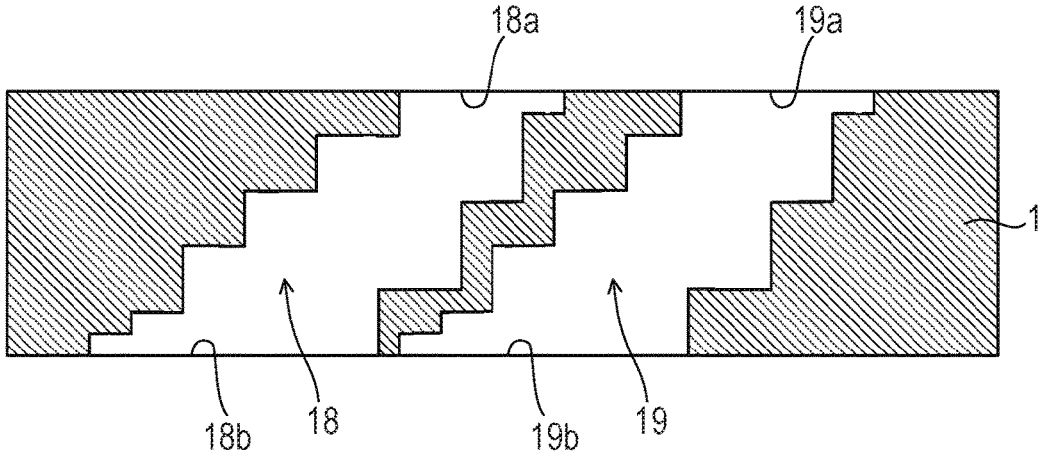

There can be instances where the position and the angle of inclination of the obliquely running through hole 8 or each of the plurality of through holes that will be formed with the above-described method become subject to limitations. Such limitations arise particularly when a plurality of through holes are to be formed through a substrate 1. As an example, an instance where a plurality of opening patterns 20, 21, 23, 24 are formed in the first and second masks 25, 22 as shown in FIG. 5A and then a plurality of through holes 18, 19 having different angles of inclination are formed in a single substrate 1 as shown in FIG. 5B will be described below. In this instance, the opening pattern 20 and the opening pattern 23 for forming a through hole 18 are located adjacent relative to each other and the opening pattern 21 and the opening pattern 24 for forming a through hole 19 are located adjacent relative to each other when viewed in the direction orthogonal relative to the flat surfaces of the substrate 1. Then, particularly, the opening patterns 20, 21 of the mask where the larger opening ends 18*b*, 19*b* of all the opening ends 18*a*, 18*b*, 19*a*, 19*b* (the second mask 22 in the instance of FIG. 5A) of the through holes 18, 19 define the physical limitations for the positions and the angles of inclination of the through holes 18, 19. More specifically, the physical limitation relative to the positional arrangement of the through holes 18, 19 are defined by such a positional relationship that the opening 20*e* arranged at an end of the opening pattern 20 and the opening 21*a* arranged at the oppositely disposed end of the opening pattern 21 are located close to each other but do not overlap each other. Then, the through hole 18 as shown in FIG. 5B is produced from the cavities 26A formed from the openings 20*a* through 20*e* and 23*a* through 23*c* of the opening patterns 20, 23 that are arranged by referring to the above-described positional physical limitation. Similarly, the through hole 19 that is located adjacent to the through hole 18 is produced from the cavities 26B formed from the openings 21*a* through 21*e* and 24*a* through 24*c* of the opening patterns 21, 24. The above-described physical limitation in turn defines the respective limitations relative to the angles of inclination of the through holes including the through holes 18 and 19 that can be formed in the substrate 1 and also the limitation relative to the degree of accumulation (arrangement density) of through holes. Then, the limitation relative to the pitch conversion by the through holes 18, 19 is defined accordingly.

Figure 6A:
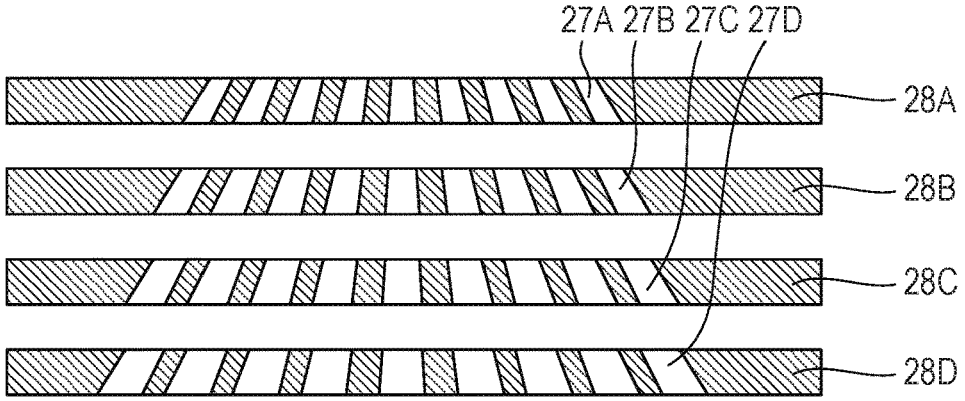
FIGS. 6A, 6B and 6C are schematic cross-sectional views of a plurality of substrates, illustrating a method of manufacturing a substrate stack, which method is the second embodiment of the present invention.
Figure 6B:
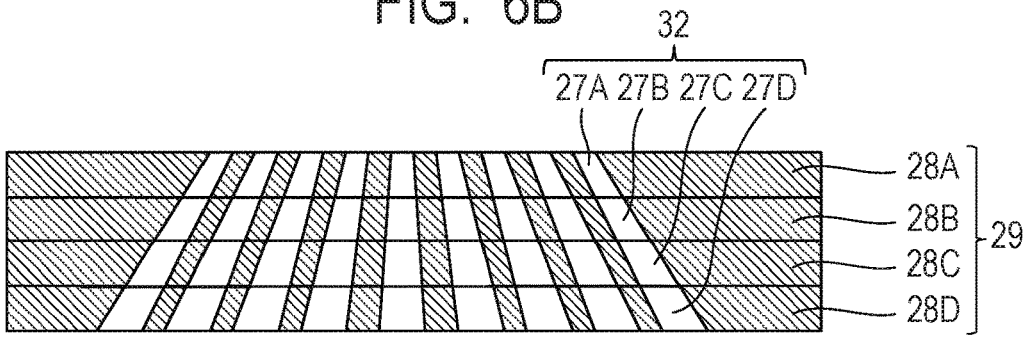

When the position and the angle of inclination of the through hole 8 of a substrate are subject to limitations as described above, a plurality of substrates 28A through 28D (FIG. 6A), respectively having a plurality of obliquely running through holes 27A through 27D may be laid one on the other (second embodiment) to overcome the limitations and realize a higher pitch conversion rate. With this embodiment, the through holes 27A through 27D of the substrates 28A through 28D are respectively connected together to produce continuous flow paths (FIG. 6B). The flow paths formed by respectively connecting the through holes 27A through 27D of the substrates 28A through 28D in the above-described manner are referred to as stack flow paths 32 in this specification. The diameter of each of the stack flow paths 32 is substantially continuously increased along the direction of stacking the plurality of substrates 28A through 28D when viewed from the side of the substrate 28A (and hence substantially continuously decreased when viewed from the side of the substrate 28D). In other words, when viewed in the stacking direction, the diameters of the through holes of the substrate stack are gradually aggrandized from the through holes 27A of the uppermost substrate 28A down to the through holes 27D of the lowermost substrate 28D. Additionally, a plurality of (a same number of) through holes 27A through 27D are formed respectively in the substrates 28A through 28D and hence a plurality of stack flow paths 32 are produced when the plurality of substrates 28A through 28D are sequentially laid one on the other to produce a substrate stack. The pitch of arrangement of the plurality of stack flow paths 32 is substantially continuously raised when viewed from the side of the substrate 28A in the stacking direction of the plurality of substrates 28A through 28D (and hence substantially continuously reduced when viewed from the side of the substrate 28D). In other words, the pitch of arrangement of the through holes is gradually increased from the through holes 27A of the uppermost substrate 28A down to the through holes 27D of the lowermost substrate 28D when viewed in the stacking direction. Techniques that can be used to stack the plurality of substrates 28A through 28D include direct bonding, plasma activated bonding, resin bonding, adhesive bonding and metal bonding.

Figure 6C:
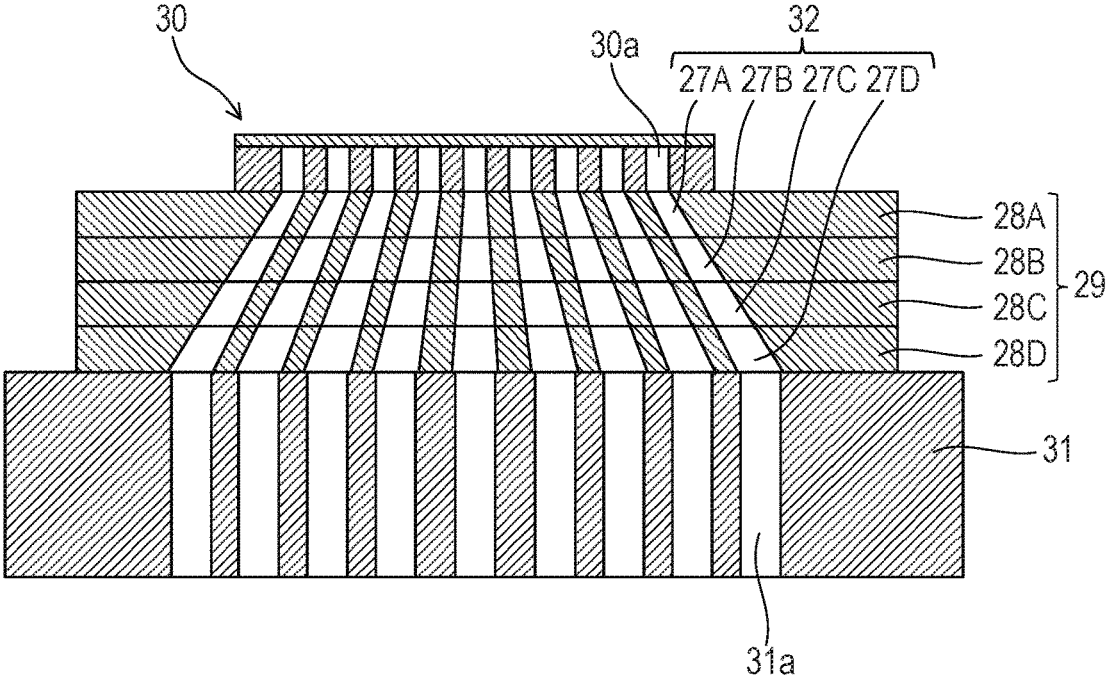

A substrate stack 29 formed by stacking substrates 28A through 28D having obliquely running through holes 27A through 27D can be employed as pitch converting member for a liquid ejection head. A liquid ejection head has a plurality of structures, in each of which part of the paths where liquid flows are formed. For example, a substrate stack 29 can be arranged as pitch converting member between a liquid ejection head substrate 30, which is one of such structures, and a supply channel member 31, which is another one of such structures (FIG. 6C). Then, the stack flow paths 32 including the through holes 27A through 27D of the substrate stack 29 respectively connect the intra-substrate flow paths (which may be common liquid chambers) 30*a* of the liquid ejection head substrate 30 and the supply channels 31*a* of the supply channel member 31 and operate for pitch conversion. Note that the substrate stack 29 shown in FIG. 6C may be replaced by a substrate 1 prepared by means of the manufacturing method illustrated in FIGS. 1A through 1D so as to operate as a pitch converting member.

Example 1

Figure 7A:
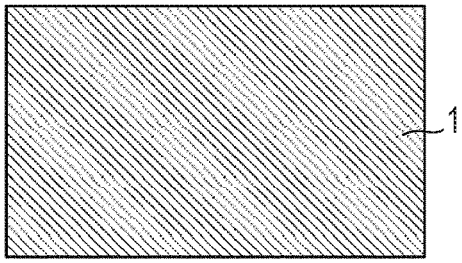
FIGS. 7A, 7B, 7C and 7D are schematic cross-sectional views of the substrate of Example 1, sequentially illustrating part of the sequential steps of the method of manufacturing the substrate employed in Example 1.
Figure 7B:
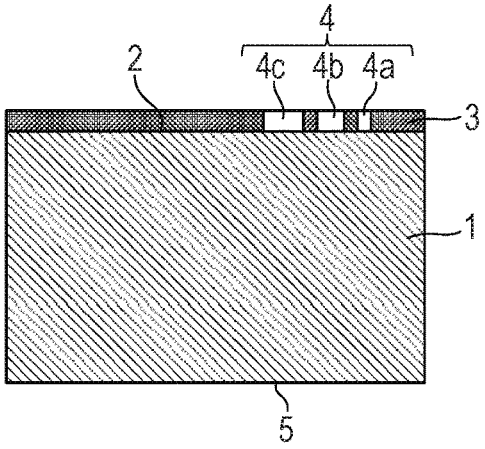
Figure 7C:
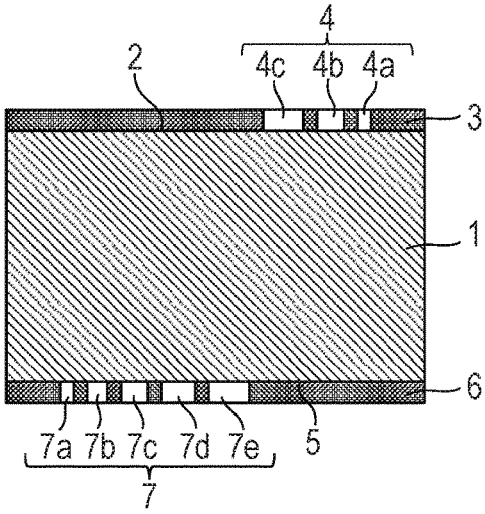

The above-described embodiment of method of manufacturing a substrate according to the present invention will be described in greater detail by way of Example 1 and by referring to FIGS. 1A through 1D and FIGS. 7A through 7D. Firstly, a 725 μm-thick silicon substrate 1 was prepared (FIG. 7A). Subsequently, the first mask 3 having an opening pattern 4 was formed by applying photoresist to the first surface 2 of the substrate 1 to a thickness of 7 μm and developing the photoresist by irradiating the photoresist with UV rays (FIG. 7B). Then, the second mask 6 having an opening pattern 7 was formed on the second surface 5 of the substrate 1 by means of the technique same as the technique of forming the first mask 3 (FIG. 7C).

Figure 7D:
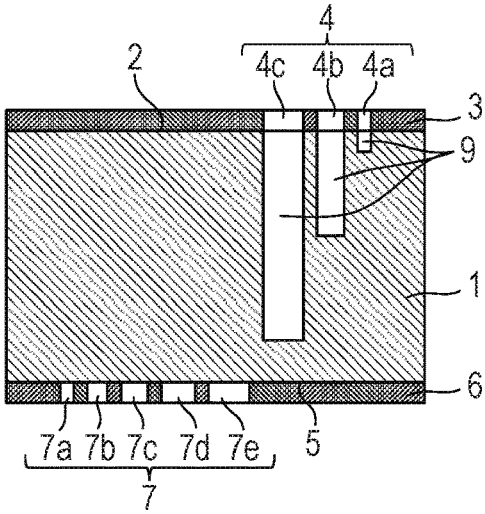

Thereafter, a vertical (anisotropic) silicon etching operation was executed from the side of the first surface 2 by way of the first mask 3 and by means of dry etching equipment, using a Bosch process (FIG. 7D). Subsequently, another vertical (anisotropic) silicon etching operation was executed from the side of the second surface 5 by way of the second mask 6 and also by means of the dry etching equipment (FIG. 1B). In this way, a plurality of cavities 9 whose depths were made to vary and change gradually according to the opening areas of the cavities 9 were produced side by side. A Bosch process is a technique of producing one or more vertically etched profiles of cavities in a substrate by alternately and repeatedly executing a protective film forming step, typically using fluorocarbon type gas such as $C_4F_8$ gas, and an etching step, typically using $SF_6$ gas.

Then, an isotropic etching operation was executed in the same dry etching equipment without using any Bosch process under conditions mainly involving the use of $SF_6$ gas. As a result of the above-described etching operation, the separating walls of silicon, each being located between two adjacently disposed cavities 9, were removed to produce an obliquely running through hole 8 (FIG. 1C). Finally, a substrate 1 having a through hole 8 with a profile as shown in FIG. 1D was obtained by peeling off the first mask 3 and the second mask 6, which masks were made of photoresist.

In this example, a plurality of openings 4*a* through 4*c* whose opening widths were made to vary stepwise between 2 μm and 100 μm were formed in the first mask 3 and any two adjacently located openings were separated from each other by an interval of 2 μm. All the openings were made to show the same opening length (e.g. 20,000 μm) as observed in the direction running perpendicularly relative to the planes of FIGS. 7A through 7D. The opening width at the opening end 8*a* of the obliquely running through hole 8 on the side of the first surface 2 of the substrate 1 was so designed as to be equal to 200 μm. The cavity 9 formed by etching from the opening 4*c* having the largest opening width (100 μm) was made to show a depth of 400 μm. The depth of the cavity formed by etching from the opening 4*a* having the smallest opening width (2 μm) was 293 μm.

On the other hand, a plurality of openings 7*a* through 7*e* whose opening widths were made to vary stepwise between 2 μm and 200 μm were formed in the second mask 6 and any two adjacently located openings were separated from each other by an interval of 2 μm. All the openings were made to show the same length (e.g. 20,000 μm) that was equal to the length of the corresponding openings 4*a* through 4*c* of the first mask 3. The opening 7*e* having the largest opening width of the second mask 6 was arranged at a position located adjacent to and horizontally separated by 2 μm from the position of the opening 4*c* having the largest opening width of the first mask 3. The opening width at the opening end 8*b* of the obliquely running through hole 8 on the side of the second surface 5 of the substrate 1 was so designed as to be equal to 400 μm. The cavity 9 formed by etching from the opening 7*e* having the largest opening width (200 μm) was made to show a depth of 400 μm. The depth of the cavity 9 formed by etching from the opening 7*a* having the smallest opening width (2 μm) was 279 μm.

Figure 8:
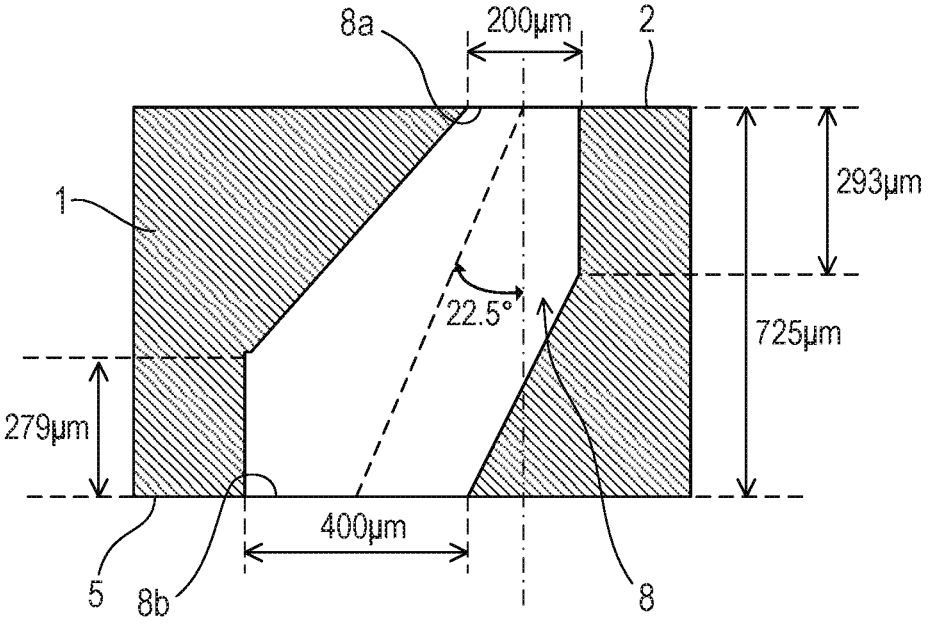
FIG. 8 is a schematic cross-sectional view of the through hole formed by the method of manufacturing the substrate of Example 1.

FIG. 8 schematically and roughly shows the profile of the through hole 8 produced as a result of the above-described operations. As for the angle of inclination of the through hole 8, the through hole 8 is inclined by 22.5° relative to the direction orthogonal to the surfaces of the substrate 1. If the opening pattern 7 of the second mask 6 was so designed that the opening width at the opening end 8*b* on the side of the second surface 5 was made to be equal to 800 μm without changing the opening pattern 4 of the first mask 3, the angle of inclination of the through hole 8 will be 34.6° relative to the direction orthogonal to the surfaces of the substrate 1 (not shown). Therefore, it is possible to change the angle of inclination of the through hole 8 by changing the widths of the opening patterns 4, 7 (the regions of arrangement of the openings) in the above-described manner.

Example 2

In Example 2, a through hole 8 was formed in a substrate by using masks 10, 12 similar to those illustrated in FIGS. 4A1 and 4A2 and following manufacturing steps similar to those of Example 1. In Example 1, cavities 9 having a depth of a little less than 300 μm were formed from the openings 4*a* having the smallest opening width of the first mask 3 and also from the openings 7*a* having the smallest opening width of the second mask 6 as shown in FIGS. 1A and 7C. The inner wall surfaces of the cavities 9 having a depth of a little less than 300 μm take the parts of the inclined lateral wall of the through hole 8 shown in FIG. 8 that are respectively connected to the corresponding edges of the opening ends 8*a*, 8*b*. However, there may arise an instance where the inclined lateral wall of the through hole 8 is desired to be more smoothly connected to the edges of the opening ends 8*a*, 8*b*. In such an instance, the use of masks 10, 12 as shown in FIGS. 4A1 and 4A2 is effective.

Therefore, a plurality of openings 11*a* through 11*c* whose opening widths were made to vary stepwise between 2 μm and 100 μm and at the same time whose opening lengths were made to vary stepwise so as to correspond to the opening widths were formed in the first mask 10. More specifically, a plurality of (e.g., nine) 2 μm×2 μm square openings 11*a* of the smallest opening width (2 μm) whose opening length was also 2 μm were arranged in row in the direction of the opening length. A number of (e.g., four) openings 11*b* whose number was smaller than the number of the openings 11*a* and whose opening length was greater than the opening length of the openings 11*a* were arranged in row in the direction of the opening length and adjacent to the row of the openings 11*a*. A single opening 11*c* having the largest opening width (100 μm) was made to have an opening length of 20,000 μm, which was the same as the length of each of the openings 4*a* through 4*c* and that of each of the openings 7*a* through 7*e* of Example 1. Any two adjacently located openings were separated from each other by 2 μm. The opening width of the opening end 8*a* on the side of the first surface 2 of the obliquely running through hole 8 was designed to be equal to 200 μm. The cavity 9 formed from the opening 11*c* having the largest opening width (100 μm) was etched to show a depth of 400 μm. The depth of the cavities 9 formed from the openings 11*a* having the smallest opening width (2 μm) was equal to 39 μm.

On the other hand, a plurality of openings 13*a* through 13*e* whose opening widths were made to vary stepwise between 2 μm and 100 μm and at the same time whose opening lengths were made to vary stepwise so as to correspond to the opening widths were formed in the second mask 12. More specifically, a plurality of (e.g., nine) 2 μm×2 μm square openings 13*a* of the smallest opening width (2 μm) whose opening length was also 2 μm were arranged in row in the direction of the opening length. A number of (e.g., seven) openings 13*b* whose number is smaller than the number of the openings 13*a* and whose length was greater than the length of the openings 13*a* were arranged in row in the direction of the opening length and adjacent to the row of the openings 13*a*. Additionally, a number of (e.g., four) openings 13*c* whose number is smaller than the number of openings 13*b* and whose length was greater than the length of the openings 13*b* were arranged in row in the direction of the opening length and adjacent to the row of the openings 13*b*. Furthermore, a number of (e.g., two) openings 13*d* whose number is smaller than the number of openings 13*c* and whose length was greater than the length of the openings 13*c* were arranged in row in the direction of the opening length and adjacent to the row of the openings 13*c*. Finally, a single opening 13*e* having the largest opening width (100 μm) was made to have an opening length of 20,000 μm, which was same as the length of each of the openings 4*a* through 4*c* and that of each of the openings 7*a* through 7*e* of Example 1. Any two adjacently located openings were separated from each other by 2 μm. The opening width of the opening end 8*b* on the side of the second surface 5 of the obliquely running through hole 8 was designed to be equal to 400 μm. The cavity 9 formed by etching from the opening 13*e* having the largest opening width (100 μm) was made to show a depth of 400 μm. The depth of the cavities 9 formed from the openings 13*a* having the smallest opening width (2 μm) was equal to 37 μm.

Figure 9:
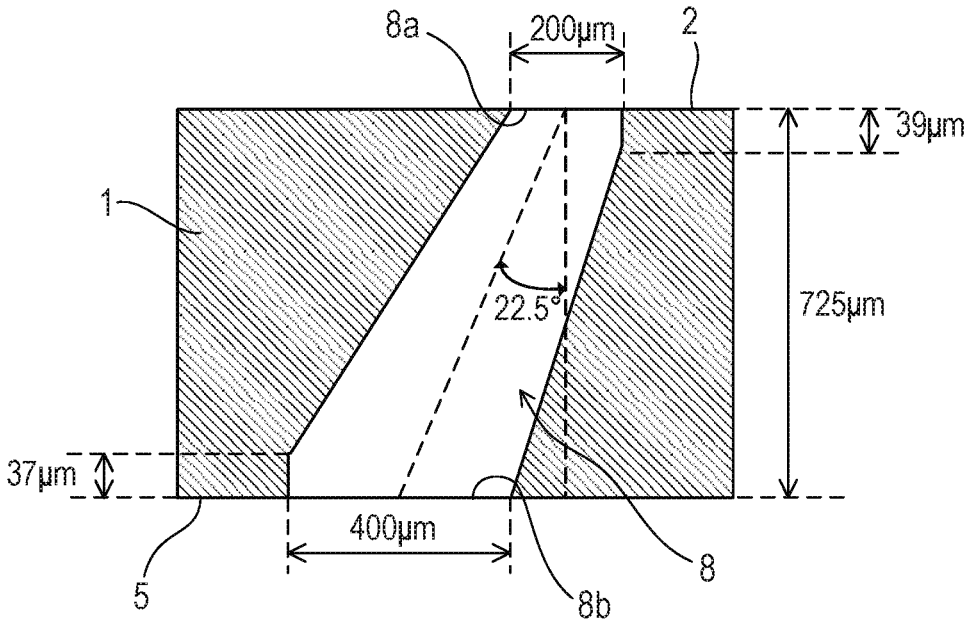
FIG. 9 is a schematic cross-sectional view of the through hole formed by the method of manufacturing the substrate of Example 2.

FIG. 9 roughly shows the profile of the produced through hole 8. The through hole 8 was inclined relative to the direction that was orthogonal to the flat surfaces of the substrate 1 by an angle of inclination of 22.5°. Thus, in this example, cavities 9 were formed to a depth of a little less than 40 μm from the openings 11*a* having the smallest opening width of the first mask 10 as shown in FIG. 4A1 and also from the openings 13*a* having the smallest opening width of the second mask 12 as shown in FIG. 4A2. The inner wall surfaces of the cavities 9 having a depth of a little less than 40 μm became parts of the lateral surface of the inclined through hole 8, each of which is directly connected either to the edge of the opening end 8*a* or to the edge of the opening end 8*b*. Thus, in the through hole 8 shown in FIG. 9, the inclined lateral surface of the through hole 8 is very smoothly connected to the edges of the opening ends 8*a*, 8*b*.

Example 3

Figure 10A:
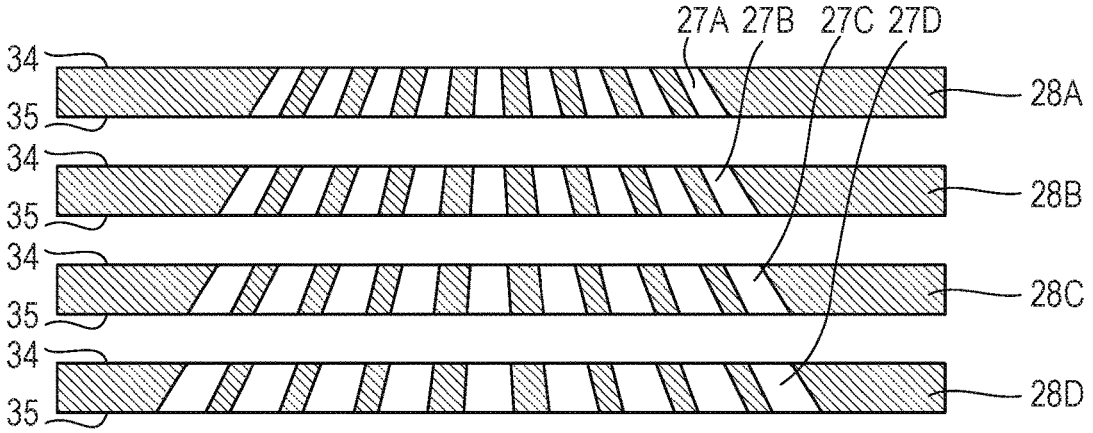
FIGS. 10A, 10B, 10C and 10D are schematic cross-sectional views of a plurality of substrates, illustrating the sequential steps of the method of manufacturing the substrate stack of Example 3.
Figure 10B:
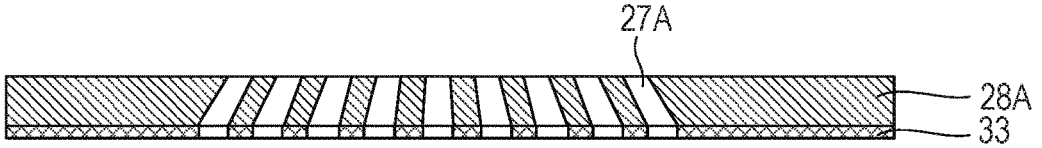
Figure 10C:
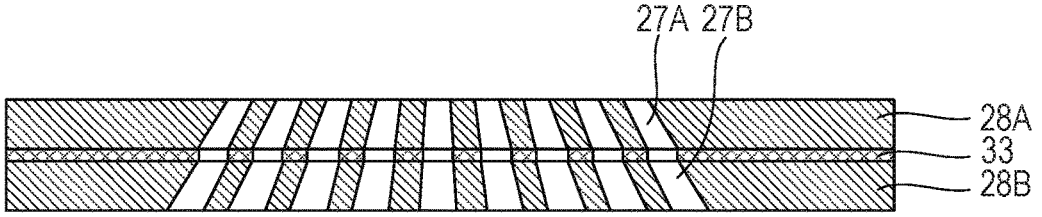

In Example 3, a plurality of (e.g., four) silicon substrates 28A through 28D that respectively had through holes 27A through 27D as shown in FIG. 10A were formed. The through holes 27A through 27D of the substrate 28A through 28D were so laid out that when the substrates 28A through 28D were laid one on the other to produce a stack, the through holes 27A through 27D were continuously connected to give rise to long through holes. Each of the substrates 28A through 28D had a thickness of 400 μm. The technique employed to prepare each of the substrates 28A through 28D was the same as the one used in Example 1. Then, an organic resin layer 33 was formed on the second surface 35 of the first substrate 28A prepared in the above-described manner (FIG. 10B). More specifically, the organic resin layer 33 was formed by applying a benzocyclobutene resin solution onto a silicon wafer to form a 2 μm-thick layer of benzocyclobutene resin and subsequently transferring the layer onto the second surface 35 of the substrate 28A. The organic resin layer 33 was formed without the areas that corresponded to the respective through holes 27A so as not to block the through holes 27A. Then, the second surface 35 of the first substrate 28A and the first surface 34 of the second substrate 28B were bonded to each other by way of the organic resin layer 33 formed on the second surface 35 of the first substrate 28A (FIG. 10C). More specifically, the organic resin layer 33 was heated to 150° C. to bind the substrates 28A, 28B together and then the organic resin layer 33 was further heated to 300° C. to properly cure the organic resin. Note that, in normal practice, the organic resin layer 33 is not heated alone but all of the substrates 28A, 28B and the organic resin layer 33 are heated together.

Figure 10D:
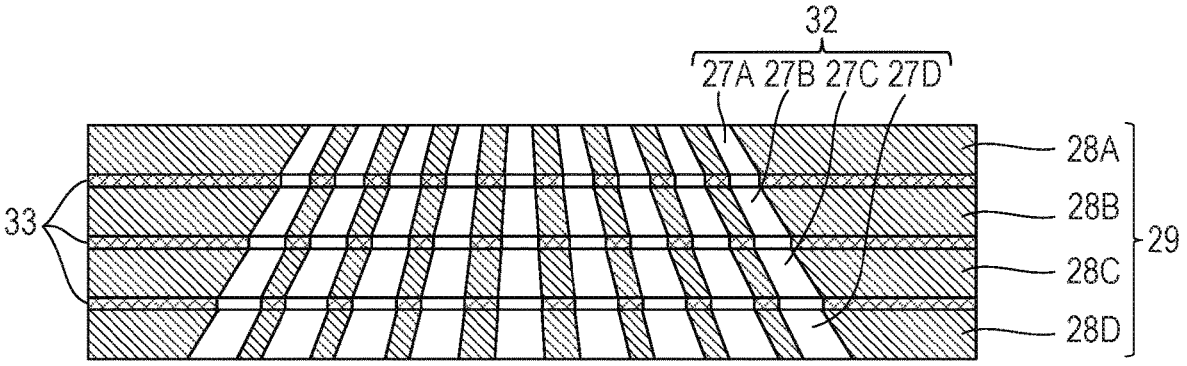

Then, the third substrate 28C and the fourth substrate 28D were additionally and sequentially bonded in a similar manner to obtain a substrate stack 29 of the substrates 28A through 28D having obliquely running through holes 27A through 27D as shown in FIG. 10D. In each of Examples 1 and 2, the 200 μm opening width of the opening end 8*a* of the through hole 8 on the first surface 2 was expanded to the 400 μm opening width of the opening end 8*b* on the second surface 5 and the center of the opening end 8*b* on the second surface 5 was horizontally shifted by 300 μm from the center of the opening end 8*a* on the first surface 2. In other words, the opening width on the second surface 5 was made to be twice of the opening width on the first surface 2 of a single substrate 1. In a similar manner, in this example, the opening width of each of the flow paths of each of the substrates 28A through 28D was expanded on the second surface to a double of the opening width on the first surface and the center of the opening end was horizontally moved from the first surface to the second surface by a half of the sum of the opening width on the first surface and the opening width on the second surface. Then, as a result, with the substrate stack 29 obtained by laying the four substrates 28A through 28D one on the other, the opening width of the stack flow paths 32 was expanded from 200 μm to 3,200 μm and the center of the opening end was horizontally moved by 4,500 μm. The number of substrates for forming a substrate stack 29 such as the above-described one is not limited to four and a higher pitch conversion rate can be realized by bonding a greater number of substrates together. The above-described technique of this example is particularly effective to realize a high pitch conversion rate when, for example, the opening width of the opening end of each of the through holes 27A on the first surface 34 of the substrate 28A, where the pitch conversion rate is smallest, is not greater than 300 μm.

Example 4

Figure 11A:
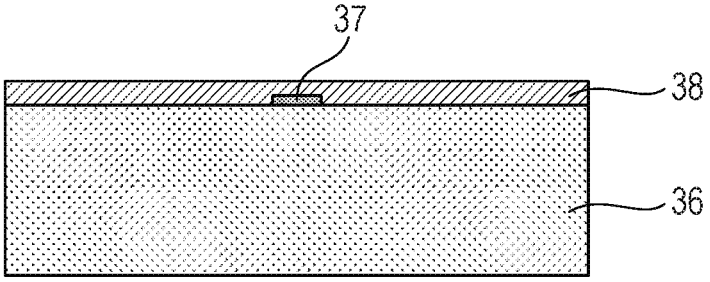
FIGS. 11A, 11B and 11C are schematic cross-sectional views of the liquid ejection head manufactured by the manufacturing method of Example 4, sequentially illustrating some of the steps of the method of manufacturing the liquid ejection head.
Figure 11B:
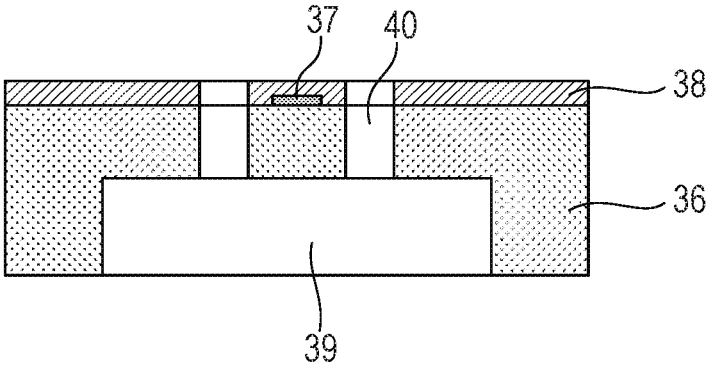
Figure 11C:
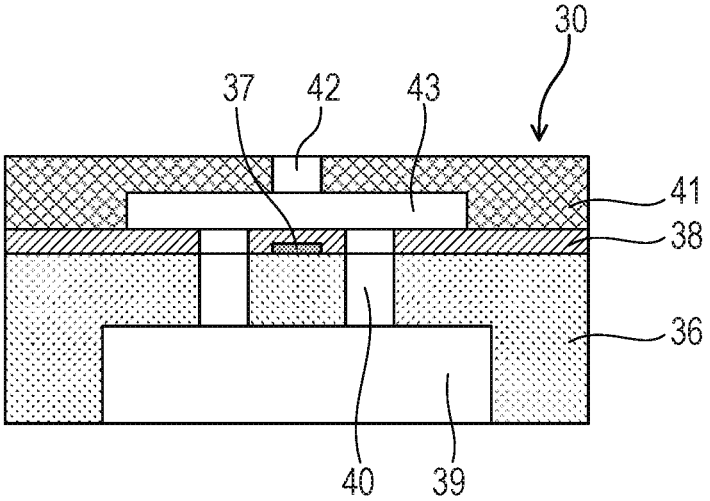

In this example, a liquid ejection head 45 was manufactured by using a substrate stack 29 prepared by means of the technique of Example 3 as pitch converting member and following the manufacturing steps illustrated in FIGS. 11A through 11C. More specifically, in this example, a 625 μm-thick silicon substrate 36 was prepared first in order to prepare a substrate 30 for a liquid ejection head, which substrate was one of the structures of the liquid ejection head. For each of the substrates 30, a heater 37, which was an energy generating element to be used for liquid ejection, was installed in advance on one of the oppositely disposed surfaces (the first surface) of the substrate 36. Additionally, a wiring layer 38 including a drive circuit and wiring for supplying electric power to the heater 37 was also formed in advance on the first surface of the substrate 36 (FIG. 11A). Part of an about 500 μm-deep flow path 39 (which corresponded to one of the intra-substrate flow paths 30*a* shown in FIG. 6C and might be a common liquid chamber) was formed on the surface (the second surface) opposite to the surface where the heater 37 was formed of the substrate 36. Furthermore, a pair of liquid supply paths 40 that communicated with the flow path 39 were formed from the first surface of the substrate 36 (FIG. 11B). The opening width of the flow path 39 was 200 μm. Thereafter, a filmy photosensitive epoxy resin was laid on the wiring layer 38 to form a flow path forming member 41. Then, a liquid ejection path 42 that included an ejection orifice on the first surface and a flow path 43 extending from the liquid supply paths 40 to the liquid ejection path 42 were formed by repeating the execution of a process of exposure and development twice on the flow path forming member 41 (FIG. 11C). The substrate 30 of the liquid ejection head that included the substrate 36 and the flow path forming member 41 was manufactured in the above-described manner.

Figure 12A:
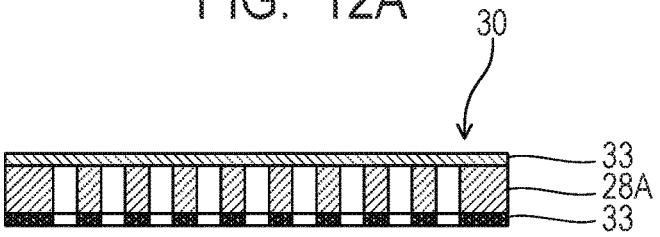
FIGS. 12A, 12B and 12C are schematic cross-sectional views of the liquid ejection head manufactured by the manufacturing method of Example 4, sequentially illustrating the steps that come after the steps of FIGS. 11A through 11C.
Figure 12B:
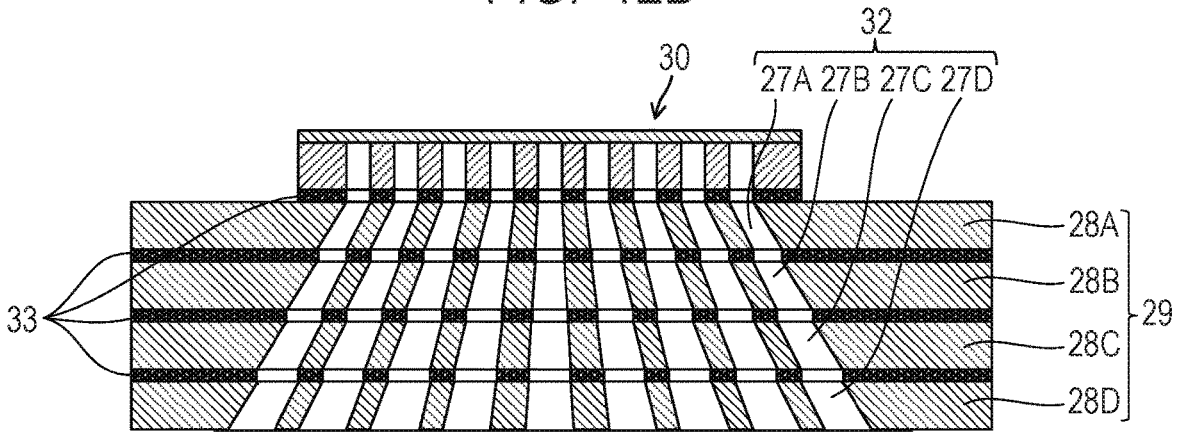
Figure 12C:
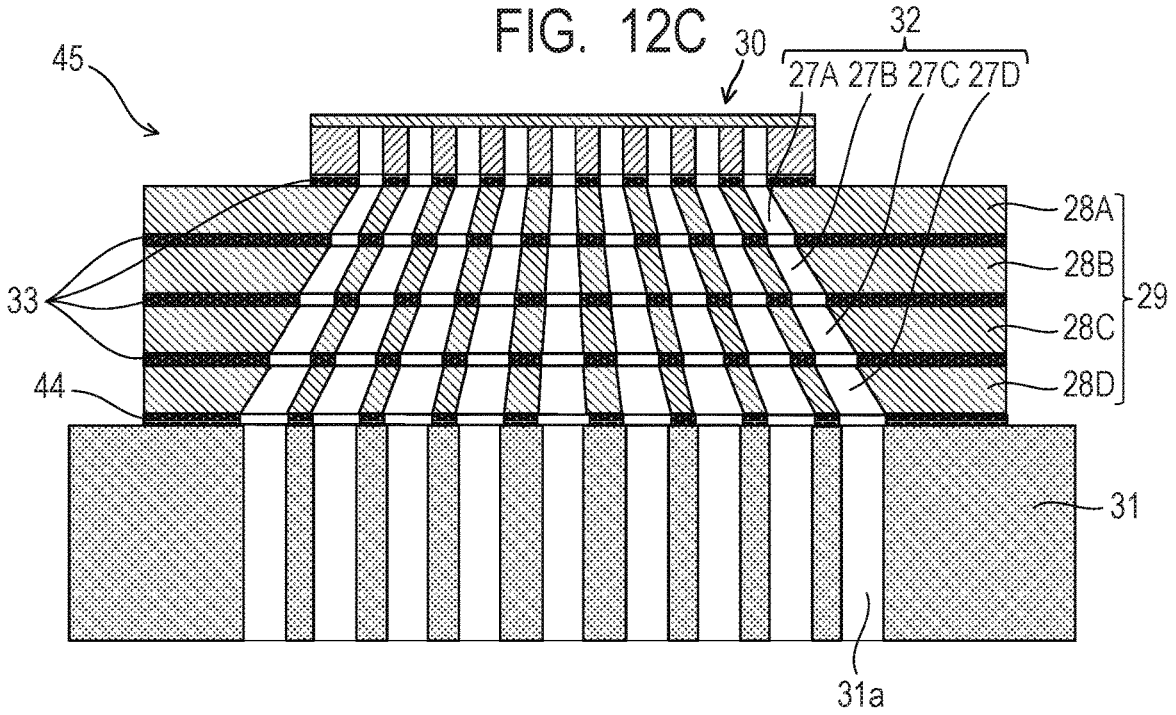
Figure 13A:
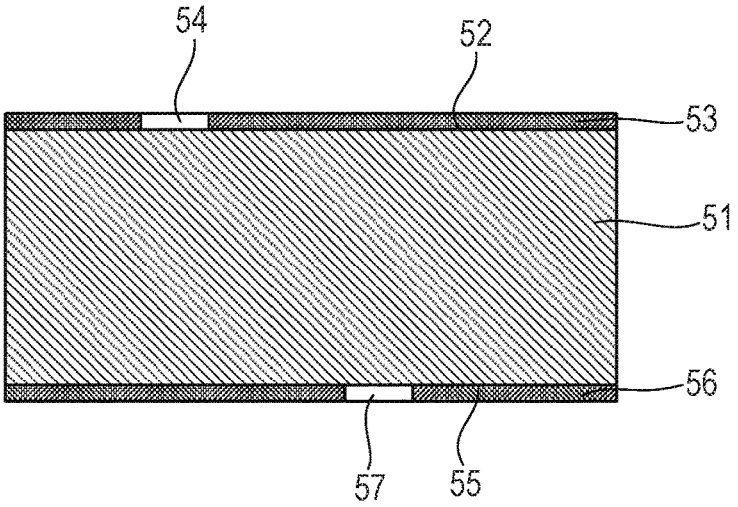
FIGS. 13A, 13B and 13C are schematic cross-sectional views of a substrate, illustrating a known method of manufacturing a substrate.
Figure 13B:
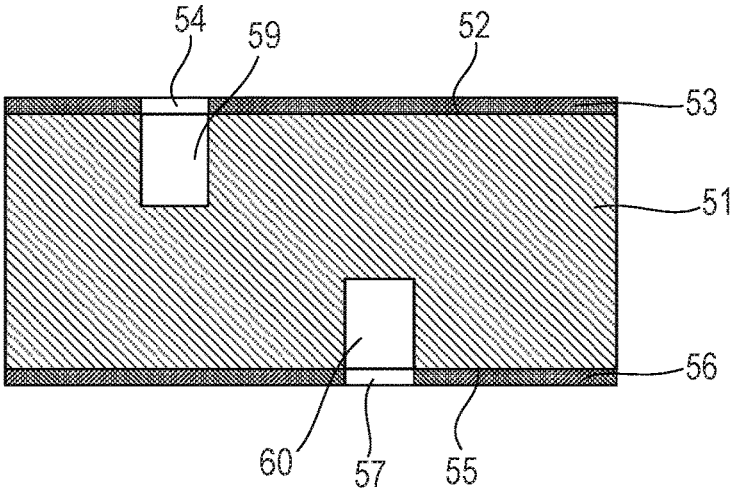
Figure 13C:
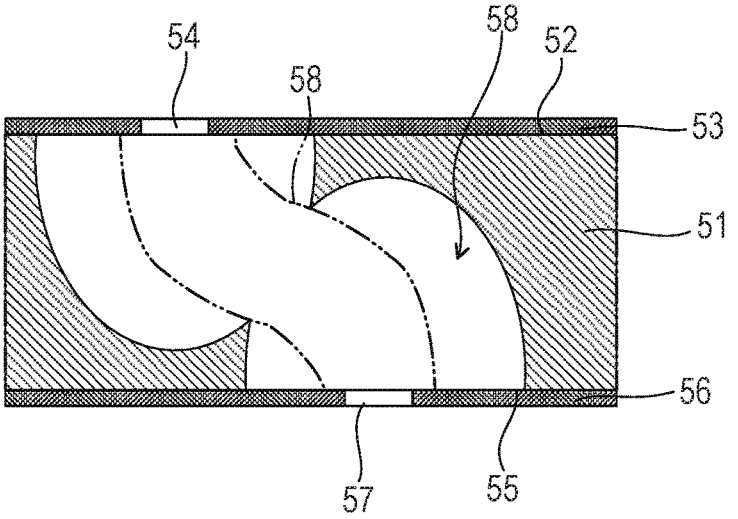

Subsequently, the substrate 30 of the liquid ejection head and a supply channel member 31, which was another one of the structures of the liquid ejection head, were connected to each other by way of a pitch converting member. A substrate stack 29 (FIG. 10D) prepared by means of a technique similar to the one employed in Example 3 was used to form the pitch converting member. The substrate 30 of the liquid ejection head and the pitch converting member 29 were bonded to each other by means of an organic resin layer 33 similar to the one employed in Example 3. More specifically, an organic resin layer 33 was formed first on the second surface of the substrate 30 of the liquid ejection head (FIG. 12A). The organic resin layer 33 was formed by applying a benzocyclobutene resin solution on a silicon wafer to produce a 2 μm-thick layer and then transferring the layer onto the second surface of the substrate 30 of the liquid ejection head. The organic resin layer 33 was formed without the areas that corresponded to the flow paths 39 so as not to block the flow paths 39. Then, the second surface of the substrate 30 of the liquid ejection head and the first surface of the pitch converting member 29 were bonded to each other by way of the organic resin layer 33 formed on the second surface of the substrate 30 of the liquid ejection head (FIG. 12B). More specifically, the organic resin layer 33 was heated to 150° C. to bind the substrates 30 of the liquid ejection head and the pitch converting member 29 together and then the organic resin layer 33 was further heated to 300° C. to properly cure the organic resin. Note that, in normal practice, the organic resin layer 33 is not heated alone but all of the substrate 30 of the liquid ejection head, the pitch converting member 29 and the organic resin layer 33 are heated together. The stack of the substrate 30 of the liquid ejection head and the pitch converting member 29 was divided by means of a dicing saw and bonded to a supply channel member 31 by using an epoxy-based adhesive agent 44 to produce a liquid ejection head 45. Thus, as a result, smooth pitch conversion was realized from the flow paths 39 having an opening width of 200 μm to the supply channels 31*a* of the supply channel member 31 having an opening width of about 3 mm.

As described above, when viewed in the direction orthogonal relative to the flat surfaces of the substrate 1, the opening pattern of the first mask arranged on the first surface of the substrate and the opening pattern of the second mask arranged on the second surface of the substrate are found to be adjacent to each other or partly overlapping each other. Each opening pattern to be used for the purpose of the present invention in order to form a through hole includes a plurality of openings. Additionally, with regard to at least part of the plurality of openings of the opening pattern of the first mask, an opening located closer to the opening pattern of the second mask has an opening area greater than the opening area of an opening located remoter from the opening pattern of the second mask when viewed in the direction orthogonal relative to the surfaces of the substrate 1. Similarly, with regard to at least part of the plurality of openings of the opening pattern of the second mask, an opening located closer to the opening pattern of the first mask has an opening area greater than the opening area of an opening located remoter from the opening pattern of the first mask when viewed in the direction orthogonal relative to the surfaces of the substrate 1. When a dry etching operation is executed from the openings of an opening pattern of a mask arranged on each of the oppositely disposed surfaces of a substrate by way of the mask, there is a tendency that the larger the opening area, the greater the etching depth. Therefore, after forming cavities in the substrate by dry etching, the cavities formed in a region of the opening pattern of the first mask located close to the opening pattern of the second mask and those formed in a region of the opening pattern of the second mask located close to the opening pattern of the first mask are deep and the cavity depth is gradually reduced toward the remotest regions from the above regions when viewed in the direction orthogonal relative to the surfaces of the substrate 1. These variations in the cavity depth produce a stepped profile of the lateral wall of the through hole to make it possible to form an obliquely running through hole. If only part of the openings of each of the opening patterns have opening areas that increase as they are closer to the opening pattern on the other surface, they take part to some extent in the operation of easily forming an obliquely running through hole as described above. Therefore, such an arrangement is also included within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-210573, filed Nov. 8, 2018, which is hereby incorporated by reference herein in its entirety.

What is claimed is:

1. A method of manufacturing a substrate having a through hole running obliquely relative to the substrate comprising:

a step of arranging a first mask having an opening pattern including a plurality of openings on a first surface of the substrate and arranging a second mask having an opening pattern including a plurality of openings on a second surface of the substrate disposed oppositely relative to the first surface;

a step of forming a plurality of cavities respectively facing the plurality of openings of the first mask by executing an anisotropic dry etching operation from the first surface by way of the first mask and forming a plurality of cavities respectively facing the plurality of openings of the second mask by executing an anisotropic dry etching operation from the second surface by way of the second mask; and a step of forming the through hole by making the cavities formed by the anisotropic dry etching from the first surface communicate with the cavities formed by the anisotropic dry etching from the second surface by removing separating walls, located among the cavities, wherein the opening pattern of the first mask and the opening pattern of the second mask are arranged adjacently relative to each other or partly overlapped with each other as viewed in a direction orthogonal relative to the first surface and the second surface of the substrate, and wherein an opening area of at least one of the plurality of openings of the first mask and of the second mask is increased along a direction from the opening pattern of one of the first or second mask including the at least one opening toward the opening pattern of the other one of the first or second mask as viewed in the direction orthogonal relative to the first surface and the second surface of the substrate.

2. The method according to claim 1, wherein an opening area of an opening end on the first surface and an opening area of an opening end on the second surface of the through hole are made different from each other.

3. The method according to claim 1, wherein a plurality of through holes having different degrees of inclination are formed in the substrate.

4. The method according to claim 1, wherein a plurality of through holes are formed in the substrate, and wherein the plurality of through holes have different values for a ratio of an opening area of an opening end on the first surface to an opening area of an opening end on the second surface.

5. A method of manufacturing a substrate stack by manufacturing a plurality of substrates by means of a method of manufacturing a substrate having a through hole running obliquely relative to the substrate comprising:

a step of arranging a first mask having an opening pattern including a plurality of openings on a first surface of the substrate and arranging a second mask having an opening pattern including a plurality of openings on a second surface of the substrate disposed oppositely relative to the first surface;

a step of forming a plurality of cavities respectively facing the plurality of openings of the first mask by executing an anisotropic dry etching operation from the first surface by way of the first mask and forming a plurality of cavities respectively facing the plurality of openings of the second mask by executing an anisotropic dry etching operation from the second surface by way of the second mask;

a step of forming the through hole by making the cavities formed by the anisotropic dry etching from the first surface communicate with the cavities formed by dry the anisotropic dry etching from the second surface by removing separating walls, located among the cavities; and laying the plurality of substrate one on another and forming a continuous stack flow path therein so that through holes formed respectively in the plurality of substrates communicate with each other, wherein the opening pattern of the first mask and the opening pattern of the second mask are arranged adjacently relative to each other or partly overlapped with each other as viewed in a direction orthogonal relative to the first surface and the second surface of the substrate, and wherein an opening area of at least one of the plurality of openings of the first mask and of the second mask is increased along a direction from the opening pattern of one of the first or second mask including the at least one opening toward the opening pattern of the other one of the first or second mask as viewed in the direction orthogonal relative to the first surface and the second surface of the substrate.

6. The method according to claim 5, wherein a diameter of the stack flow path is made to continuously increase or decrease along a direction of sequentially laying the plurality of substrates one on the other.

7. The method according to claim 5, wherein a plurality of through holes are formed in each of the plurality of substrates and a plurality of stack flow paths are formed in the substrate stack of the plurality of substrates, and wherein a pitch of arrangement of the plurality of stack flow paths is continuously increased or decreased along a direction of sequentially laying the plurality of substrates one on the other.

8. The method according to claim 5, wherein an opening width of at least one of opening ends of the through hole formed in the substrate is not greater than 300 μm.

9. A method of manufacturing a liquid ejection head having a plurality of structures, each having part of a path for flowing liquid, including manufacturing a substrate by means of a method of manufacturing a substrate having a through hole running obliquely relative to the substrate comprising:

a step of arranging a first mask having an opening pattern including a plurality of openings on a first surface of the substrate and arranging a second mask having an opening pattern including a plurality of openings on a second surface of the substrate disposed oppositely relative to the first surface;

a step of forming a plurality of cavities respectively facing the plurality of openings of the first mask by executing an anisotropic dry etching operation from the first surface by way of the first mask and forming a plurality of cavities respectively facing the plurality of openings of the second mask by executing an anisotropic dry etching operation from the second surface by way of the second mask;

a step of forming the through hole by making the cavities formed by the anisotropic dry etching from the first surface communicate with the cavities formed by the anisotropic dry etching from the second surface by removing separating walls, located among the cavities; and arranging the substrate among the plurality of structures as a pitch converting member, wherein the opening pattern of the first mask and the opening pattern of the second mask are arranged adjacently relative to each other or partly overlapped with each other as viewed in a direction orthogonal relative to the first surface and the second surface of the substrate, and wherein an opening area of at least one of the plurality of openings of the first mask and of the second mask is increased along a direction from the opening pattern of one of the first or second mask including the at least one opening toward the opening pattern of the other one of the first or second mask as viewed in the direction orthogonal relative to the first surface and the second surface of the substrate.

10. The method according to claim 9, wherein the plurality of structures among which the pitch converting member is arranged include a substrate of the liquid ejection head having common liquid chambers and a supply channel member having a supply channel.

* * * * *